US009608341B2

(12) United States Patent
Saur et al.

(10) Patent No.: US 9,608,341 B2
(45) Date of Patent: Mar. 28, 2017

(54) HIGH-CURRENT PLUG-IN CONNECTION WITH MULTI-ARM CONTACT LAMELLAE

(71) Applicant: Robert Bosch GmbH, Stuttgart (DE)

(72) Inventors: Martin Saur, Salach (DE); Zhenyu Hu, Leonberg (DE)

(73) Assignee: ROBERT BOSCH GMBH, Stuttgart (DE)

( * ) Notice: Subject to any disclaimer, the term of this patent is extended or adjusted under 35 U.S.C. 154(b) by 0 days.

(21) Appl. No.: 14/914,667

(22) PCT Filed: Aug. 25, 2014

(86) PCT No.: PCT/EP2014/068013

§ 371 (c)(1),
(2) Date: Feb. 26, 2016

(87) PCT Pub. No.: WO2015/028434

PCT Pub. Date: Mar. 5, 2015

(65) Prior Publication Data

US 2016/0211590 A1 Jul. 21, 2016

(30) Foreign Application Priority Data

Aug. 29, 2013 (DE) ..... 10 2013 217 256

(51) Int. Cl.
*H01R 13/187* (2006.01)
*H01R 4/48* (2006.01)

(52) U.S. Cl.
CPC ..... *H01R 4/48* (2013.01); *H01R 13/187* (2013.01)

(58) Field of Classification Search
USPC ..... 439/843
See application file for complete search history.

(56) References Cited

U.S. PATENT DOCUMENTS

| | | | | |
|---|---|---|---|---|
| 3,286,671 | A | 11/1966 | Fuller | |
| 4,128,293 | A | 12/1978 | Paoli | |
| 6,062,919 | A | 5/2000 | Trafton | |
| 8,784,143 | B2 * | 7/2014 | Edgell | A61N 1/3752 439/246 |

(Continued)

FOREIGN PATENT DOCUMENTS

| | | |
|---|---|---|
| DE | 19703984 | 8/1988 |
| DE | 102004029834 | 12/2005 |

(Continued)

OTHER PUBLICATIONS

International Search Report for PCT/EP2014/068013, issued Nov. 10, 2014.

*Primary Examiner* — Tho D Ta
(74) *Attorney, Agent, or Firm* — Gerard Messina

(57) ABSTRACT

A socket for a high-current plug-in connection is provided, which includes a contact sleeve and a hollow cylindrical contacting system. The contacting system includes a plurality of elongated contact lamellae, is situated in an inner area of the contact sleeve, and is supported with at least a portion of its outer wall on the inner wall. The contact lamellae extend between a first collar and a second collar of the contacting system. The socket includes a contact lamella, in an area between the first collar and second collar, having an arm, via which the contact lamella is additionally connected to a collar of the contacting system in a supporting manner.

11 Claims, 4 Drawing Sheets

(56) References Cited

U.S. PATENT DOCUMENTS

2014/0357137 A1* 12/2014 Sian ..... H01R 13/187
439/843

FOREIGN PATENT DOCUMENTS

| | | |
|---|---|---|
| DE | 202009011839 | 2/2010 |
| DE | 102009001573 | 8/2010 |
| EP | 0342385 | 11/1989 |
| EP | 0442639 | 8/1991 |

* cited by examiner

HIGH-CURRENT PLUG-IN CONNECTION WITH MULTI-ARM CONTACT LAMELLAE

BACKGROUND INFORMATION

Today, high electrical current intensities are transferred in many fields of technology. In recent years, increasingly higher currents are being transferred, also in modern vehicles in growing numbers, in particular in the area of electromobility or hybrid vehicles.

In particular when connecting elements and contact elements are used, various requirements for secure contacting, and at the same time low electrical resistance and high service life, are often imposed. In addition, for use in motor vehicles, additional specific requirements may apply for a plug-in connection, for example due to vibrations which occur or use-related temperature fluctuations.

German Patent Application No. DE 10 2004 029 834 A1 describes an electrical contact element in the form of a coil spring having multiple windings. The windings have the shape of a polygon, which allows transfer of a high current. A low insertion force and a high tolerance compensation are thus provided.

SUMMARY

Example embodiments of the present invention are based on the considerations described below. Elastic contact elements, for example in the form of elongated contact lamellae which protrude inwardly from the contact sleeve, are frequently used in high-current plug-in connections for contacting and current transfer between a contact pin and a contact sleeve. These contact elements may be fixedly connected to the contact sleeve, for example. The electrical connection may be established by introducing the contact pin into the contact sleeve. The elastic contact element should mechanically hold the contact pin in the contact sleeve and also compensate for a possible tolerance of the contact pin-contact sleeve system.

Such an elastic deflection behavior may be achieved, for example, with a plurality of contact lamellae having fairly thin cross sections. A larger number of lamellae may, if necessary, allow a larger number of contact points, which for a given overall current intensity may advantageously reduce the current intensity to be transferred in each case to a contact point, and may reduce an overall contact resistance between the contact lamellae and the contact pin. However, thicker cross sections of contact lamellae may be advantageous with regard to a lower electrical series resistance within the contact lamellae and with regard to a larger contact force of the contact lamella on the contact pin. Implementing these sometimes conflicting requirements for contact lamellae may in many cases require compromises concerning an advantageous design.

Mechanical and electrical properties, among other things, of a plug-in connection, in particular of a high-current plug-in connection, may be improved with the aid of specific embodiments of the present invention.

Therefore, according to one aspect of the present invention, a socket for accommodating a cylindrical contact pin is provided for establishing a high-current plug-in connection. The high-current plug-in connection includes a contact sleeve with a circumferential hollow cylindrical inner wall, and a hollow cylindrical contacting system which is designed for extending into a space between the contact sleeve and the contact pin which is introduced into an inner area of the contact sleeve surrounded by the inner wall. The contacting system includes a plurality of elongated contact lamellae which are designed for forming a mechanical and electrical contact between the contact pin and the contact sleeve when a contact pin is introduced into the inner area of the contacting system. The contacting system is situated in the inner area of the contact sleeve, and the contacting system extends in its circumferential direction along the inner wall of the contact sleeve and is supported with at least a portion of its outer wall on the inner wall. The contacting system includes a first collar and a second collar which in each case extend at their two end-face sides in the circumferential direction. The contact lamellae extend between the first and second collars, and with their respective ends are connected to the collar. The socket is characterized in that a contact lamella includes an arm, in an area between the first and second collars, via which the contact lamella is additionally connected to a collar of the contacting system in a supporting manner.

In the context of the present patent application, for better readability the term "a contact lamella" is not to be construed as being limited to "exactly one contact lamella." Rather, the term is to be construed as "at least one contact lamella" or as at least one of the contact lamellae"; i.e., multiple or all contact lamellae may also be meant. Likewise, the term the contact lamella" thus means "the at least one contact lamella" or "at least one of the contact lamellae."

One advantage may be considered to be that, due to supporting the arm, which is additionally provided on the lamella at a locally spaced position on the collar, a higher contact force between the contact lamella or the arm and the contact pin may be achieved, which may result in a lower electrical resistance, higher mechanical stability, and better wear resistance. In addition, due to the arm, a further current path is provided which may effectuate a better spatial distribution of the currents, and thus, lower localized current intensities, in particular in the area of the contact lamella having fairly small cross sections.

A contact sleeve may be electrically conductive, and on its outer side may additionally include, for example, a plastic layer or also an electrical shield which is applied in an insulated manner for mechanical protection and for insulation. In addition, the contact sleeve may be electrically and mechanically connected to a supply lead via appropriate connecting devices.

The contacting system in its hollow cylindrical shape may be understood, for example, as a lamella cage which has elongated recesses on the side surfaces between the lamellae. This structure of the contacting system may be created, for example, by punching out from a metal sheet and subsequent bending into a hollow cylindrical shape. In particular, the contacting system may have a one-piece design.

The contact lamellae and the arm may have various shapes, for example strips having the same or different localized width. A length of the contact lamella may be 15 mm to 20 mm, for example, and a width may be 2 mm to 5 mm, for example. The arm may be designed in one piece with the contact lamella, or may also rest against the contact lamella or the collar in an electrically conductive manner. In one example, the arm may protrude in one piece from the collar and rest against the contact lamella in a supporting manner.

In one specific embodiment of the present invention, the contact lamella together with the arm has a Y-shaped design. A Y shape may have the advantage that the resulting overall three legs of the contact lamella together with the arm may allow a stable position of the contact lamella in the circumferential direction, from a static standpoint. In other words, the lamella is fastened to one collar at at least two points, and to the other collar at one point. In one example, the lamella is supported with the arm on one collar at at least one further point in comparison to the other collar. In addition, the arm or arms result(s) in the option for additional contact points between the contact pin and the contact lamella or between the contact sleeve and the contact lamella.

In one specific embodiment, the arm of the contact lamella is supported on an adjacent contact lamella. The two adjacent lamellae together with the arm situated in between may form an H shape. This may have the advantage that the overall stability of the contacting system may be increased, and additional current paths may also be formed via the arm and the adjacent contact lamella. The arm may, for example, be designed in one piece with the first and second contact lamellae. In another example, the arm is designed in one piece with the contact lamella and rests against the adjacent contact lamella in a supporting manner.

In one exemplary embodiment, the contact lamellae and/or the arm have/has bulges in the radial direction of the contacting system which are designed for contacting the contact pin or the contact sleeve in each case. The advantage of the bulges may be a plurality of defined contact points which delimit, among other things, a length of the current paths across the contact lamellae. In one example, the contact lamellae together with the bulges are made of a spring steel, and may thus allow an elastic deflection in the radial direction. Bulges may have a corrugated profile or other suitable profiles in their longitudinal section in parallel to a longitudinal axis of the contact sleeve.

In one exemplary embodiment, the spatial arrangement of the contact lamellae and of the arm and a spatial arrangement of the bulges are designed in such a way that bulge maxima of adjacent contact lamellae in the circumferential direction of the contact sleeve are offset with respect to one another, or that bulge maxima of adjacent contact lamellae are offset with respect to one another or situated spaced apart from one another along the circumference of this projection of the contact sleeve, in an axial projection on a plane which is orthogonal with respect to the longitudinal axis. This may have the advantage that the contact points on the contact pin are distributed more uniformly across the circumference. In other words, multiple contact points may be prevented from simultaneously sliding along the same surface line, extending in the axial direction of the contact sleeve, when the contact pin is inserted. For example, abrasive wear on the surface of the contact pin may be reduced in this way.

In one exemplary embodiment, the contacting system is designed in such a way that the bulges of the contact lamella elastically deflect when a deflection force is applied in the direction of the inner wall of the contact sleeve, thus increasing an overall length of the contacting system. One advantage may be considered to be that an elastic deflection may allow locking of the contact pin in the contact sleeve, and in addition good electrical contacting may be achieved due to the contact force that is generated.

Due to the radial movement, partial areas of the contact lamella are shifted in the axial direction along the inner wall of the contact sleeve or along a surface of the contact pin. An overall length of the contacting system is increased in this way.

In one specific embodiment of the present invention, the contacting system is connected to the contact sleeve at one of the collars. A defined position of the contacting system within the contact sleeve as well as additional electrical contacting between the contacting system and a collar and/or between the contacting system and the contact sleeve may be achieved in this way. This connection may also be used to prevent the contacting system from sliding out of the inner area of the contact sleeve when the contact pin is not inserted. For example, the collar may be connected to the contact sleeve via a weld spot.

In one specific embodiment of the present invention, the collar situated at one end-face side of the contact sleeve has a protrusion which projects beyond an edge of the contact sleeve on the end-face side, for example beyond the edge in the radial direction, and overlaps or encompasses same, for example, so that moving of the contacting system into the contact sleeve is limited. This may have the advantage that when a contact pin is inserted into the cross section of the contact sleeve the friction with the contacting system created thereby prevents the contacting system from being pushed undesirably far into an interior of the contact sleeve. Due to the protrusion, the end-face side of the contact sleeve may be utilized as a retaining surface. In one example, a protrusion is permanently fastened to the end face of the contact sleeve with the aid of a weld spot, for example.

In one specific embodiment, the contacting system has a gap along its entire longitudinal extension. The gap thus also extends through both collars. In another specific embodiment of the present invention, the contacting system is designed in such a way that a circumference of the collars of the contacting system is elastically expandable, and the collars of the contacting system in an unexpanded state are situated spaced apart from the inner wall of the contact sleeve, at least in areas.

One advantage may be considered to be that the contacting system may be easily inserted into the inner area of the contact sleeve due to a fairly small circumference, for example, but when the contact pin is inserted, a preferably large area of the contacting system may come into contact with the inner wall of the contact sleeve. In other words, the gap or the elastic expandability allows a limited increase in the circumference of the contacting system within the contact sleeve when the contact pin is inserted into the cross section of the contacting system.

In another aspect of the present invention, a high-current plug-in connection is provided which includes a socket as described above. For example, the high-current plug-in connection is made up of a socket and a correspondingly dimensioned contact pin which is designed for being inserted into the socket to establish an electrical and mechanical connection. A high-current plug-in connection may be characterized in particular by use in applications in which high currents occur, for example in the range of 50-300 A.

It is pointed out that possible features and advantages of a socket according to the present invention are described herein with reference to various specific embodiments. It is understood by those skilled in the art that the individual features may be suitably combined or exchanged with one another in order to achieve further specific embodiments and possible synergy effects.

BRIEF DESCRIPTION OF THE DRAWINGS

Specific embodiments of the present invention are described below with reference to the figures; neither the description nor the figures are to be construed as limiting for the present invention.

The figures are purely schematic and not true to scale. Identical or functionally equivalent features are denoted by the same reference numerals in the figures.

DETAILED DESCRIPTION OF EXAMPLE EMBODIMENTS

Figure 1A:
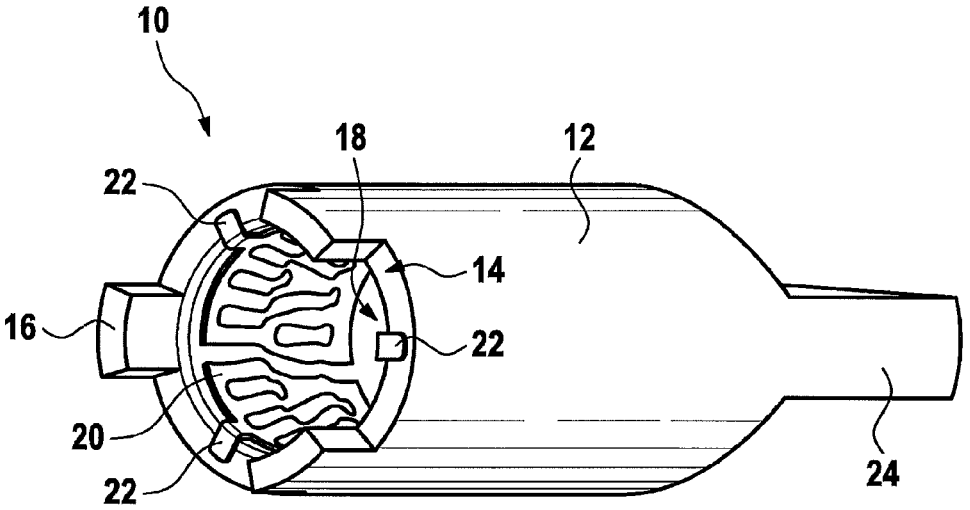
FIG. 1A shows an example socket according to the present invention together with a contacting system in a three-dimensional illustration.

FIG. 1A shows a simplified configuration of a socket 10 together with a contact sleeve 12. In the example shown here, contact sleeve 12 includes at least one recess 14 and at least one locking pin 16—in the exemplary embodiment illustrated, three recesses 14 and three locking pins 16 each—at the edge of a facing side for inserting a contact pin (not illustrated). Recess 14 and locking pin 16 may be understood as additional features of socket 10 which may be used for mechanical stabilization. A contacting system 20 is situated in an inner area 18 of contact sleeve 12. On a side facing the end-face side of contact sleeve 12, contacting system 20 has multiple protrusions 22 in the radial direction which rest against the end-face side of contact sleeve 12 in such a way that contacting system 20 is prevented from unintentionally moving too far into inner area 18 of contact sleeve 12 when a contact pin (not shown) is inserted. An axial support of protrusions 22 is also conceivable. In addition, contact sleeve 12 may have connection options for a connecting cable (not shown) at an end 24 on the cable side.

Figure 1B:
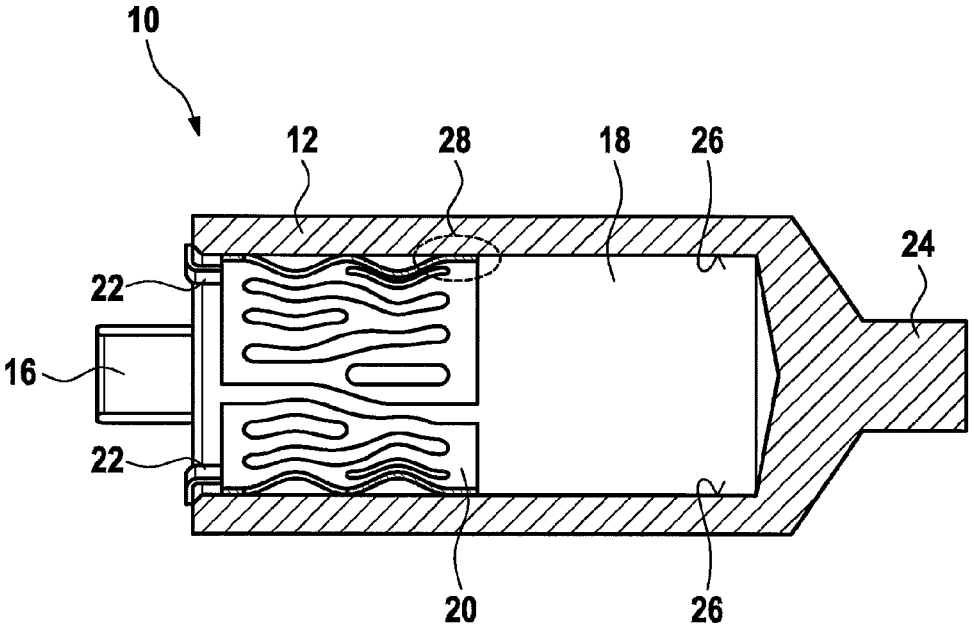
FIG. 1B shows an example socket according to the present invention together with a contacting system in a longitudinal sectional illustration.

FIG. 1B shows a longitudinal sectional illustration of socket 10 from FIG. 1A. Contacting system 20 with its outer wall rests against a hollow cylindrical inner wall 26 of contact sleeve 12. Contacting system 20 in its circumference extends in a space between a contact pin (not shown) to be introduced into inner area 18, and inner wall 26 of contact sleeve 12. Contacting system 20 extends in its circumferential direction along inner wall 26 of contact sleeve 12 and is supported, at least with a portion of its outer wall, on inner wall 26. For example, contacting system 20 contacts inner wall 26 at a contact point 28 on the collar side. An axial movement of contacting system 20 in the direction of an inner area 18 is limited by multiple protrusions 22 which are formed in the radial direction.

Figure 2:
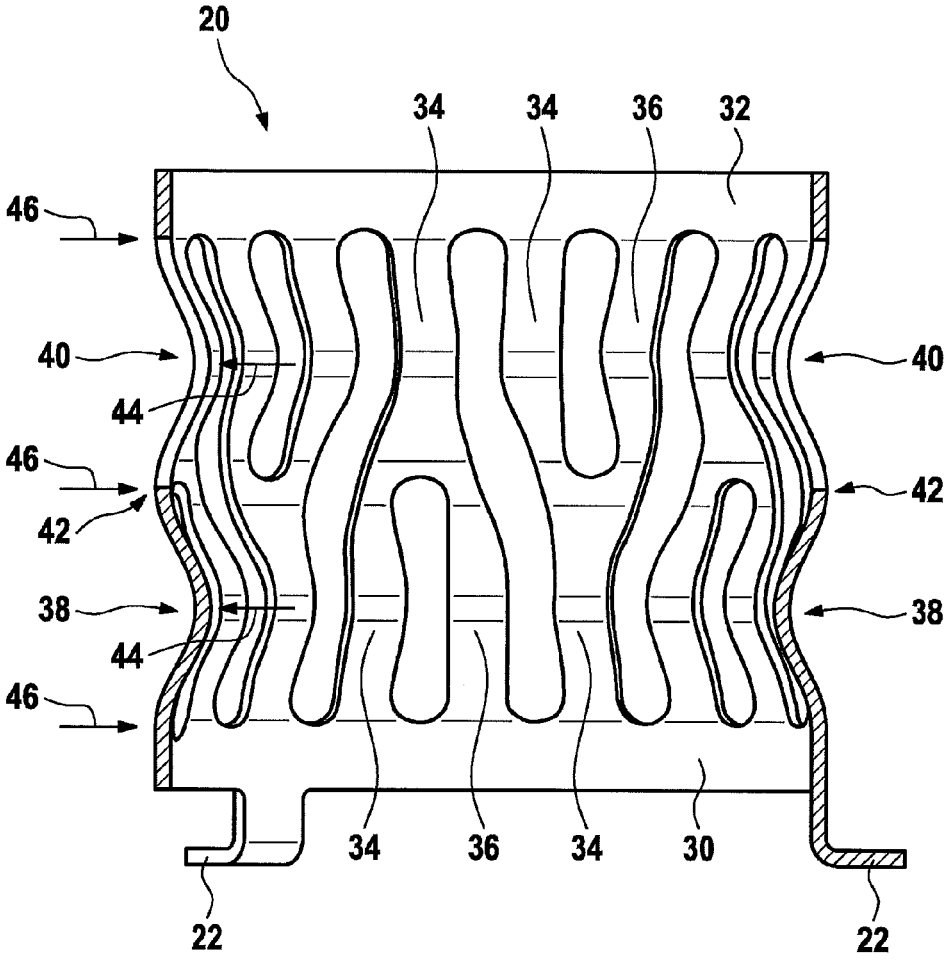
FIG. 2 shows an example of a contacting system of an example socket according to the present invention in a longitudinal sectional illustration.

FIG. 2 shows an example of a contacting system 20 in a longitudinal sectional illustration. Contacting system 20 includes a first collar 30 and a second collar 32. Contact lamellae 34, which are additionally supported with one arm 36 on first collar 30 and on second collar 32, extend in each case between first collar 30 and second collar 32. Alternatively, contact lamella 34 could also extend from a collar 30, 32 via arm 36 to oppositely situated collar 32, 30, and the support would take place via the area of contact lamella 34 extending in parallel. In other words, contact lamella 34 together with arm 36 has a Y-shaped design.

Distributed across the circumference of contacting system 20, contact lamellae 34, which together with an arm 36 have a Y-shaped design, are provided in alternation as an upright Y shape and as an upside-down Y shape between first collar 30 and second collar 32. Stated in another way, for a first contact lamella 34, for example arm 36 of this first contact lamella 34 is connected to second collar 32 in a supporting manner, while for contact lamellae 34 adjacent to this first contact lamella 34, arm 36 thereof is then connected to first collar 30 in a supporting manner. The neighboring contact lamella one over from first contact lamella 34 then once again has the same orientation as first contact lamella 34; i.e., arm 36 thereof is once again connected to second collar 32 in a supporting manner. Due to this alternating pattern, the surface of the circumference of contacting system 20 is advantageously covered very densely with material of contact lamellae 34 or their arms 36.

Contacting system 20, viewed along the axial direction, in each case has a first radial inwardly directed bulge 38 and a second radial inwardly directed bulge 40, as well as a radially outwardly directed bulge 42 situated in between, on its contact lamellae 34. In other words, a corrugated profile of contact lamella 34 results, viewed in an axial longitudinal section. First inwardly directed bulge 38 and second inwardly directed bulge 40 are designed in such a way that at their bulge maximum, in each case they form a contact point with an inserted contact pin (not shown). The inserted contact pin exerts an outwardly directed contact force 44 on contact lamella 34 and on arm 36 of contacting system 20 via first inwardly directed bulge 38 and second inwardly directed bulge 40. Outwardly directed bulge 42 is designed to form at its bulge maximum a contact point with inner wall 26 of contact sleeve 12 (see FIGS. 1A and 1B). Inner wall 26 exerts an inwardly directed contact force 46 on first collar 30, second collar 32, and outwardly directed bulge 42. Contact forces 44, 46 allow mechanical and electrical contacting between the contact pin and contact sleeve 12 via contacting system 20. Contacting system 20 also has protrusions 22 (shown here in the radial direction by way of example) for axially positioning contacting system 20 within contact sleeve 12.

Figure 3A:
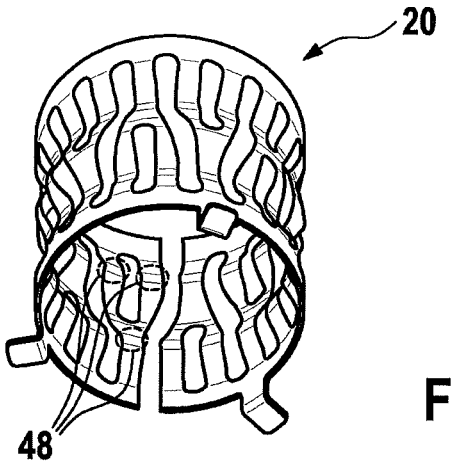
FIGS. 3A through 3C show an example of a contacting system of an example socket according to the present invention in various three-dimensional illustrations.

FIG. 3A shows the contacting system from FIG. 2 with contact points 48 on the contact pin side, each of which is situated at the bulge maxima of first and second bulges 38, 40 (see FIG. 2).

Figure 3B:
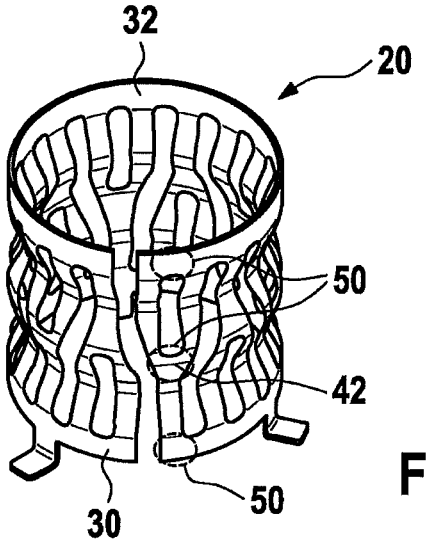

FIG. 3B likewise shows contacting system 20 according to FIG. 2 with contact points 50 on the (contact) sleeve side, which are situated at collars 30, 32 and a bulge maximum of outwardly directed bulge 42 of contact lamella 34.

Figure 3C:
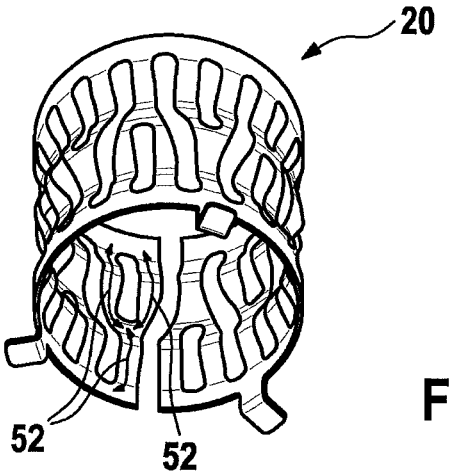

FIG. 3C shows contacting system 20 together with current paths 52, illustrated by arrows. For example, an electrical current is relayed from the contact pin (not shown) via the first and second inwardly directed bulges via current paths 52 of contact lamella 34 and of arm 36, i.e., from contact points 48 on the contact pin side to contact points 50, on the sleeve side, and is transferred to inner wall 26 of contact sleeve 12. The adjacent arrangement of respective contact points 48 on the contact pin side and contact points 50 on the sleeve side advantageously result in an increased number of contact points between the contact pin and contact sleeve 12, as well as in short current paths, which may be advantageous in particular for small conductor cross sections, and in increased contact forces 44, 46. In other words, with each leg, a Y-shaped contact lamella 34, 36, i.e., contact lamella 34 and its arm 36, contacts the contact pin (this results in three contact points with the contact pin for each contact lamella), the circumferential metal strips of collars 30, 32 and outwardly directed bulge 42 contacting contact sleeve 12. This may allow improved wear resistance and reliable contacting due to an overall robust design.

Figure 4A:
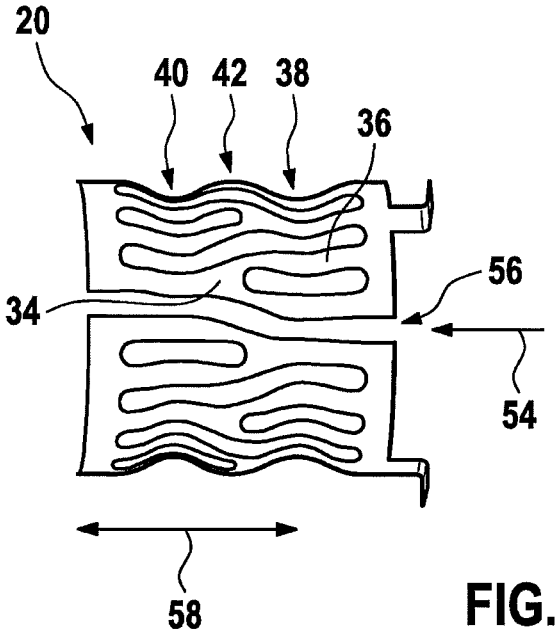
FIGS. 4A and 4B show an example of a contacting system of an example socket according to the present invention under the aspect of an elongation in the longitudinal direction and circumferential direction, respectively.

FIG. 4A shows contacting system 20 in a simplified longitudinal sectional illustration. When a contact pin (not shown) is inserted into a cross section of contacting system 20 in insertion direction 54, this results in a deflection and deformation of bulges 38, 40, 42 of contact lamellae 34 together with respective arms 36. As a result, an outer surface of contacting system 20 slides along inner wall 26 of the contact sleeve (see FIGS. 1A, 1B) in the longitudinal direction of contact sleeve 12, and thus effectuates an elongation of the contacting system in longitudinal direction 58. In addition, the contacting system has a gap 56 along its longitudinal extension.

Figure 4B:
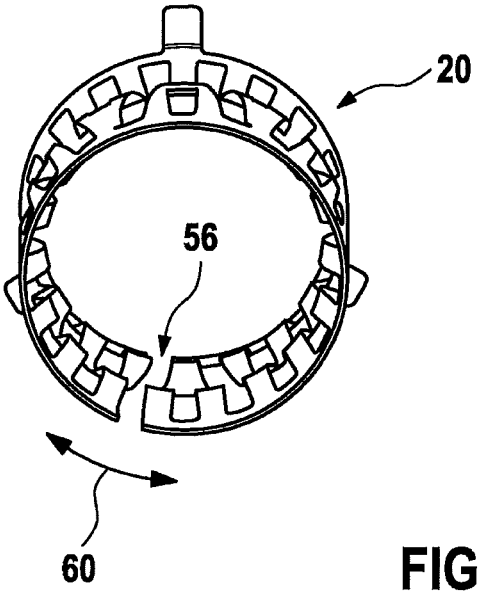

As shown in FIG. 4B, this opening in contacting system 20 provided on one side and on the longitudinal side by gap 56 effectuates an enlargement of circumference 60. As a result, on the one hand a spring elastic effect, and on the other hand an advantageous clamping of the contact pin in contact sleeve (see FIGS. 1A, 1B), may be achieved. In addition, an advantageous contact of the contacting system against inner wall 26 of contact sleeve 12 over a fairly large surface area, and thus better contacting, may be achieved.

In addition, it is to be noted that "including" does not exclude other elements or steps, and "a" or "an" does not exclude a plurality. In addition, it is pointed out that features or steps which have been described with reference to one of the above exemplary embodiments may also be used in combination with other features or steps of other exemplary embodiments described above.

What is claimed is:

1. A socket for accommodating a cylindrical contact pin for establishing a high-current plug-in connection, comprising:

a contact sleeve with a circumferential hollow cylindrical inner wall; and a hollow cylindrical contacting system which is designed for extending into a space between the contact sleeve and the contact pin which is introduced into an inner area of the contact sleeve surrounded by the inner wall;

wherein the contacting system includes a plurality of elongated contact lamellae which are designed for forming a mechanical and electrical contact between the contact pin and the contact sleeve when a contact pin is introduced into the inner area;

wherein the contacting system is situated in the inner area of the contact sleeve, and the contacting system extends in its circumferential direction along the inner wall of the contact sleeve and is supported with at least a portion of its outer wall on the inner wall;

wherein the contacting system includes a first collar and a second collar which in each case extend at their two end-face sides in a circumferential direction;

wherein the contact lamellae extend between the first and second collars, each of the contact lamellae being connected at a respective first end to the first collar and at a respective second end to the second collar;

wherein each of the contact lamellae includes a respective arm, in an area between the first and second collars, via which the contact lamella is additionally connected to one of the first and second collars in a supporting manner, each of the contact lamellae together with its respective arm being in a Y-shape, and wherein each of the contact lamellae including its respective arm, being bulged in at least two areas of its Y-shape, each of the bulged areas for contacting, in each case, either the contact pin or the contact sleeve.

2. The socket as recited in claim 1, wherein the arm of the contact lamella is supported on an adjacent contact lamella.

3. The socket as recited in claim 1, wherein the contacting system has a gap along its entire longitudinal extension.

4. The socket as recited in claim 1, wherein the contacting system is designed in such a way that a circumference of the first and second collars of the contacting system is elastically expandable, and the collars of the contacting system in an unexpanded state are situated spaced apart from the inner wall of the contact sleeve, at least in areas.

5. The socket as recited in claim 1, wherein one of the bulged areas of each of the contact lamellae and its respective arm is for contacting the contact pin, and another of the bulged areas of each of the contact lamellae and its respective arm is for contacting the contact sleeve.

6. The socket as recited in claim 1, wherein a spatial arrangement of the contact lamellae and of the arm and a spatial arrangement of the bulged areas are designed in such a way that bulge maxima are offset with respect to one another in a circumferential direction of the contact sleeve.

7. The socket as recited in claim 6, wherein the contacting system is designed so that the bulged areas of the contact lamella elastically deflect when a deflection force is applied in a direction of the inner wall of the contact sleeve to increase an overall length of the contacting system.

8. The socket as recited in claim 7, wherein the contacting system is connected to the contact sleeve at one of the first or second collars.

9. The socket as recited in claim 8, wherein at least one of the first and second collars has a protrusion which projects beyond an edge of it, so that moving of the contacting system into the contact sleeve is limited.

10. A high-current plug-in connection which includes a socket, the socket for accommodating a cylindrical pin, the socket comprising:

a contact sleeve with a circumferential hollow cylindrical inner wall; and a hollow cylindrical contacting system which is designed for extending into a space between the contact sleeve and the contact pin which is introduced into an inner area of the contact sleeve surrounded by the inner wall;

wherein the contacting system includes a plurality of elongated contact lamellae which are designed for forming a mechanical and electrical contact between the contact pin and the contact sleeve when a contact pin is introduced into the inner area;

wherein the contacting system is situated in the inner area of the contact sleeve, and the contacting system extends in its circumferential direction along the inner wall of the contact sleeve and is supported with at least a portion of its outer wall on the inner wall;

wherein the contacting system includes a first collar and a second collar which in each case extend at their two end-face sides in a circumferential direction;

wherein the contact lamellae extend between the first and second collars, each of the contact lamellae being connected at a respective first end to the first collar and at a respective second end to the second collar;

wherein each of the contact lamellae includes a respective arm, in an area between the first and second collars, via which the contact lamella is additionally connected to one of the first and second collars in a supporting manner, each of the contact lamellae together with its respective arm being in a Y-shape; and wherein each of the contact lamellae including its respective arm, being bulged in at least two areas of its Y-shape, each of the bulged areas for contacting, in each case, either the contact pin or the contact sleeve.

11. The high-current plug-in connection as recited in claim 10, wherein one of the bulged areas of each of the contact lamellae and its respective arm is for contacting the contact pin, and another of the bulged areas of each of the contact lamellae and its respective arm is for contacting the contact sleeve.

* * * * *